US005628546A

United States Patent [19]

Boetzkes

[11] Patent Number: 5,628,546

[45] Date of Patent: May 13, 1997

[54] DENTAL PATIENT'S CHAIR

[75] Inventor: Peter C. Boetzkes, North Vancouver, Canada

[73] Assignee: Dentech Products, Inc., Clearbrook, Canada

[21] Appl. No.: 315,950

[22] Filed: Sep. 30, 1994

[51] Int. Cl.[6] ..... A47C 1/032

[52] U.S. Cl. ..... 297/316; 297/322; 297/354.13; 297/330

[58] Field of Search ..... 297/83, 84, 316, 297/319, 321, 322, 330, 342, 354.13, 362.11

[56] References Cited

U.S. PATENT DOCUMENTS

| | | | |
|---|---|---|---|
| 2,662,582 | 12/1953 | Lorenz | 297/83 |
| 2,850,078 | 9/1958 | Lorenz | 297/83 |
| 3,056,629 | 10/1962 | Fletcher | 297/316 |
| 3,578,379 | 5/1971 | Taylor | 297/316 X |
| 4,505,514 | 3/1985 | Stöchl et al. | 297/322 |
| 5,131,717 | 7/1992 | Kaminiski et al. | 297/316 |
| 5,190,349 | 3/1993 | Austin, Jr. et al. | 297/316 |
| 5,315,726 | 5/1994 | Borenstein | 297/161 |

*Primary Examiner*—Peter R. Brown
*Attorney, Agent, or Firm*—Foster & Foster

[57] ABSTRACT

A dental patient's chair which is fully and completely adjustable which includes a foot control system that eliminates the need to manipulate any hand-operated control knobs or levers. The dental patient's chair includes a linkage assembly which allows the seat to pivot and move in the same manner as the human body when the human body articulates about the complex pivot created at the pelvic bone, the upper legs, and the lower part of the backbone. The dental patient's chair allows the patient's body to remain in the same position relative to the backrest and the seat of the patient's chair as the chair is articulated in a variety of positions.

23 Claims, 10 Drawing Sheets

DENTAL PATIENT'S CHAIR

TECHNICAL FIELD

This invention relates to chairs for patients undergoing treatment, and more particularly, to dental patient chairs.

BACKGROUND OF THE INVENTION

Dental patient's chairs come in a variety of types, styles, and sizes. Traditional dental patients' chairs are adjustable, typically by means of a simple pivot between the seat and the backrest which allows for simple articulation of the back as it rotates about the pivot. Such traditional chairs are, however, problematic for a number of reasons. First, it is typically important that the patient's head does not move relative to the headrest. Any time movement of a traditional dental chair is desired, the backrest pivots about an axis common to the seat. Upon pivoting the backrest, a person typically must move anywhere from a few to several inches in the chair in order to be seated squarely on the seat cushion with the backrest in the proper supporting position. Necessarily, the position of the patient's head relative to the headrest will change. This requires the treating physician to readjust the headrest.

Further, with respect to the patient's head, the patient's jaw and skull relative to the patient's backbone must be oriented in an optimal position for the dentist, oral surgeon or other treating physician to access the areas of the mouth. If the head and jaw move relative to the patient's backbone during adjustment of the chair, the patient may not be able to open his or her mouth sufficiently or there may be some other impediment to accessing the mouth areas.

A primary problem with respect to traditional dental patients' chairs is that the pivot axis, particularly a simple pivot between the backrest and the seat, is not coincident with the axis of the human body "pivot." Therefore, the person's body and the seat when articulating will not remain in constant, identical contact with one another. One attempt to solve this problem has been to try to locate the axis of the chair pivot close to the axis that is assumed to be where rotation of the upper torso takes place relative to the lower body. This, however, creates two problems. First, this would require a large hinge mechanism on the chair well above the seat cushion level that would get in the way of the patient getting in and out of the chair.

Perhaps more importantly, the human body does not pivot like a simple hinge. Rather, the human body has one hinge between the upper legs and the pelvic bone, and a second hinge between the lower part of the backbone and that same pelvic bone. This creates a complex hinge mechanism that must be dealt with in a sophisticated way.

An overriding consideration in today's medical profession, including the dental profession, is contamination. With the ever-increasing presence of serious diseases, such as AIDS, hepatitis, and the like, contamination has become particularly important. A major problem with respect to any dental patient's chair is the need for the treating physician to adjust the chair manually. For example, the physician is typically required to manipulate a variety of manually controlled switches or buttons, such as to adjust the headrest, backrest, or even the light used in treating the patient. Each time such an adjustment is required, the treating physician must put down the instruments, and readjust the particular piece of equipment. Any contamination on the treating physician's gloves will contaminate any of these various manually operated adjustments. These same adjustments are those that are typically not thought of when sterilization takes place between patients, as compared to the physician's instruments and the like.

Another important consideration is the patient's comfort and sense of security. The patient should not feel that he or she is sliding up and down in the seat in an uncontrolled manner, particularly where critical angles of inclination are involved. This occurs when a simple pivot, described above, is used in a patient's chair.

Some attempts have been made to place a sliding mechanism in the backrest portion of a chair to allow for the back to move when the seat is being reclined. Once again, however, this does not recognize the complex pivot that occurs in the human body. In addition, any mechanisms added to the backrest of the chair will create an impediment to the doctor performing work on the patient. In designing a dental patient's chair, the backrest should be kept as thin as possible so the doctor can have maximum patient positioning freedom while keeping his knees and legs free to get close to his patient.

There is a need, therefore, to provide a dental patient's chair that can be completely and fully manipulated without the need of the treating physician to touch any part of the chair with his or her hands. There is a further need to develop a dental patient's chair that pivots in the same complex manner as the human body so that when the chair is reclined, the human body will follow both the backrest and the seat in the exact same manner. This would eliminate any need for the patient to readjust him or herself in the chair, and would maintain the head in the relatively same position on the headrest.

The present invention relates to a dental patient's chair that is fully and completely adjustable by the use of a unique foot control system that eliminates the need to manipulate any hand-operated control knobs or levers. The present invention also involves a sophisticated linkage assembly which allows the seat to pivot and move in the same manner as the human body when the human body articulates about the complex pivot created at the pelvic bone, the upper legs, and the lower part of the backbone. This allows the patient's body to remain in the same position relative to the backrest and the seat of the patient's chair as the chair is articulated in a variety of positions. Other advantages, features, and objects of the invention will become more apparent from the detailed description of the invention that follows.

BRIEF DESCRIPTION OF THE DRAWINGS

Preferred embodiments of the invention are described below with reference to the accompanying drawings, which are briefly described below.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
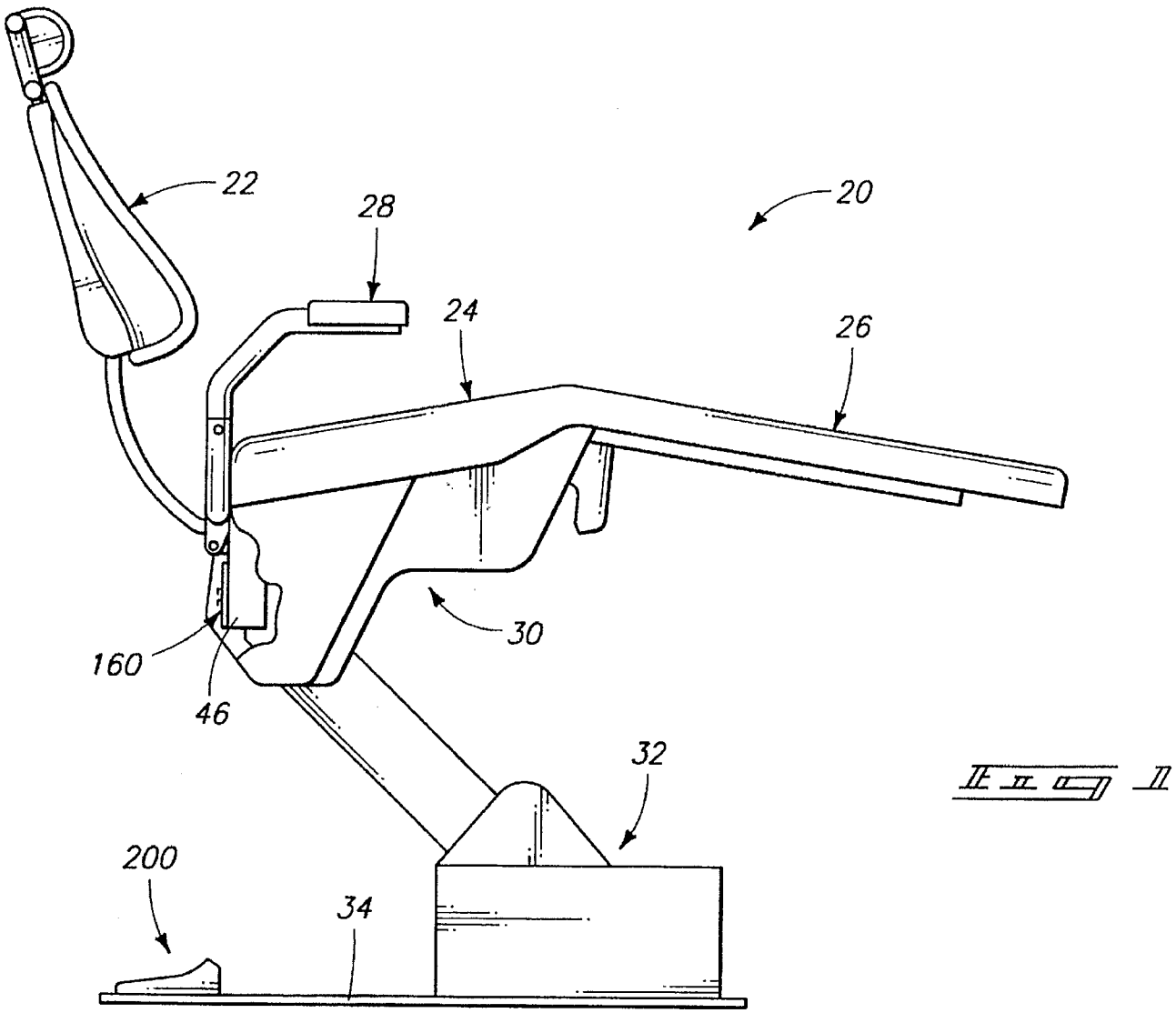
FIG. 1 is a side elevation view of a dental patient's chair according to the present invention.

FIG. 1 shows a dental patient's chair 20 generally comprising a backrest assembly 22, a seat assembly 24, a footrest assembly 26, an armrest assembly 28, a linkage assembly 30, a lift mechanism 32, and a base or platform 34. The dental patient's chair is operated solely and exclusively by a programmable foot control apparatus 200 which can be positioned anywhere on the ground at the rear end of the dental patient's chair. Ideally, it will be positioned for convenient operation by the treating physician. The foot control apparatus emits an infrared signal which is transmitted to and received by a PC board 160 mounted inside of the dental patient's chair. The chair shown in FIG. 1 includes a breakaway portion to show where the PC board 160 may be located.

Figure 6:
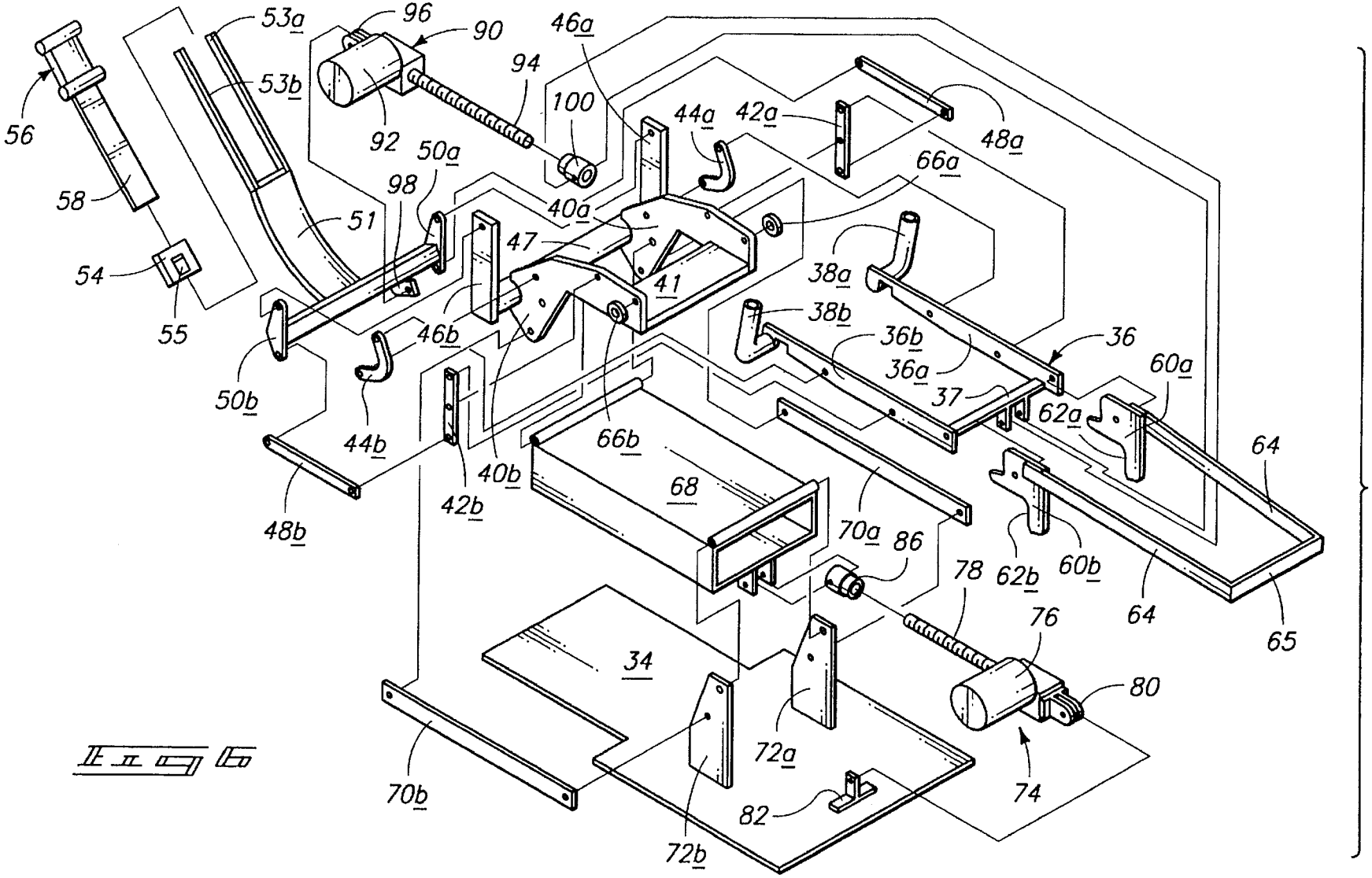
FIG. 6 is an exploded view of the linkage assemblies of the present invention.

FIGS. 2 through 6 show more specifically the various features of the dental patient's chair. The seat assembly 24 includes a seat frame 36 which is moved through a variety of horizontal and vertical positions as the chair articulates because of the main linkage assembly 30. The frame comprises side members 36 which are attached to one another by a cross bar 37. (FIG. 6 shows left and right components of the chair that are mirror images of one another by adding an "a" or a "b" designation to the component number). A pair of arm posts 38 are rigidly coupled to the frame 36. A pair of armrests 39 are coupled, in turn, to the arm posts 38.

The seat frame 36 moves generally relative to the main or reference frame 40. The reference frame comprises side members 40, which are secured together by a cross brace 41 and a tubular cross member 47. The seat frame 36 is attached to the reference frame 40 solely by means of a butterfly linkage member 42 and a boomerang-shaped linkage member 44. The main frame further comprises upstanding arms 46 which are fixedly coupled to the ends of tubular cross member 47. The top ends of arms 46 pivotally couple the backrest assembly thereto at triangular shaped brackets 50. A pair of push bars 48 are coupled at one end to the triangular pieces 50 and pivotally coupled at opposite ends to the butterfly linkage members 42. When the chair is articulated, the push bars 48 urge the lower portion of the butterfly bars 42 toward the front of the chair, which causes the top portion of the butterfly linkage members 42 to move the seat in a rearward position. The boomerang linkage member 44 moves the seat in an upward position as the seat frame 36 moves relative to the reference frame 40. The butterfly and boomerang members are different lengths and pivotally mounted in the manner shown so that the seat tilts when the it moves between the forward/rearward and upward/downward directions.

Figure 2:
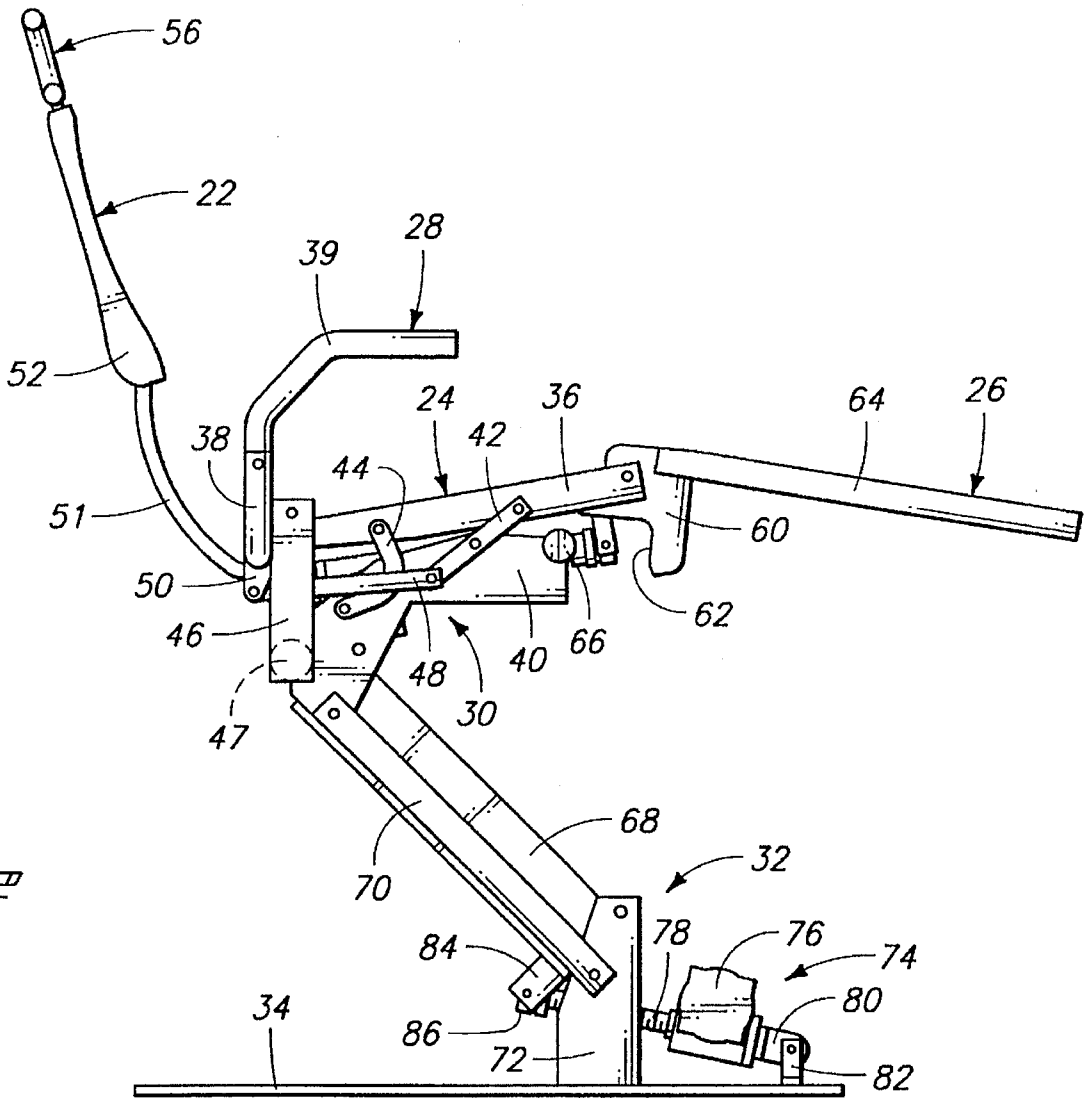
FIG. 2 is a side elevation view of the dental patient's chair of FIG. 1 showing the various linkage mechanisms of the chair.
Figure 3:
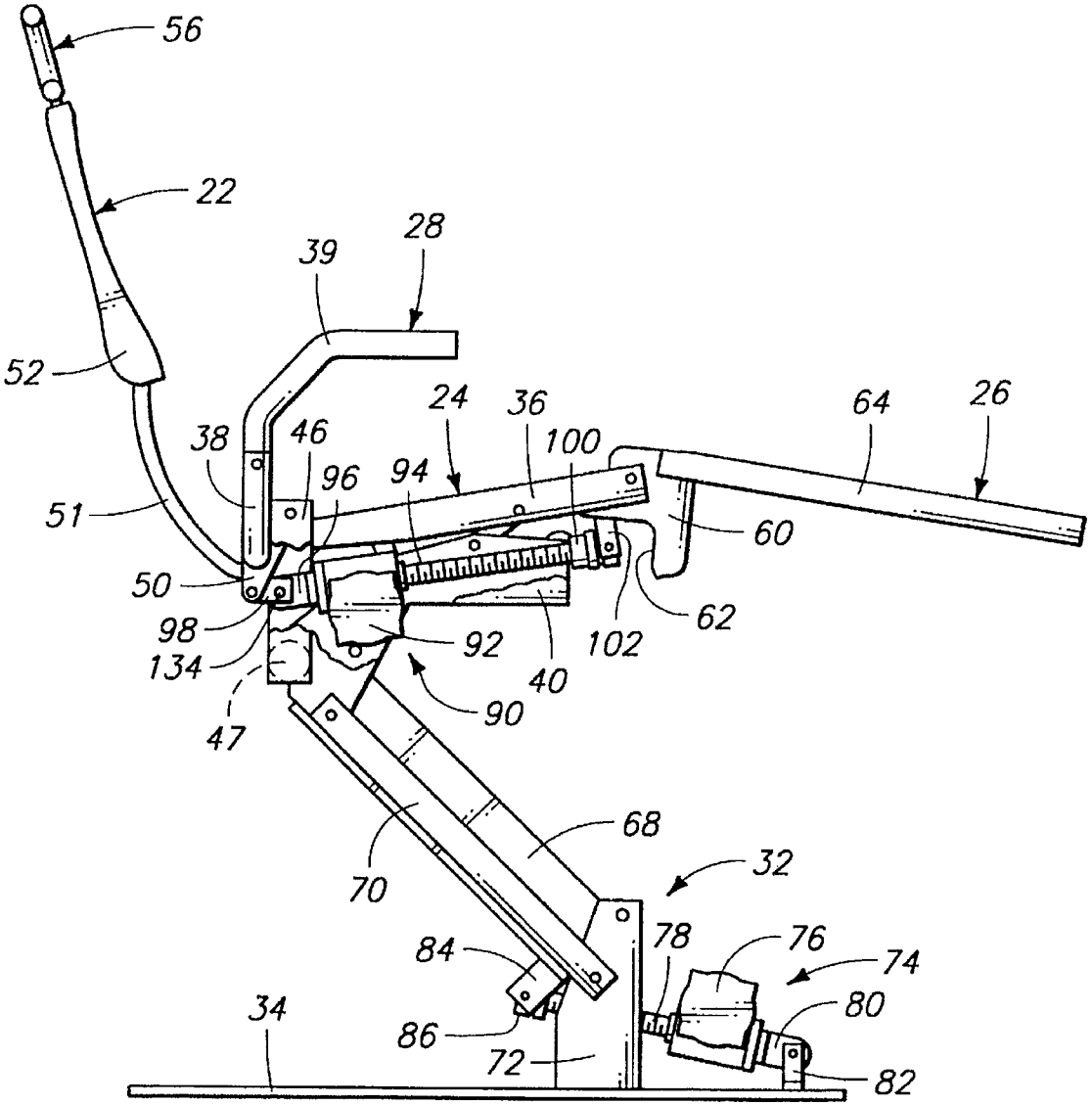
FIG. 3 is a side elevation view of the dental patient's chair of FIG. 1 with a portion of the linkage broken away to show a drive mechanism for adjusting the chair.

The backrest assembly 22 is coupled to the seat frame assembly 24 by means of a pair of triangular-shaped brackets 50 which are interconnected to one another by means of a cross bar (unnumbered), as shown in FIG. 6. A banana-shaped bracket 51 is fixedly coupled to the cross bar and the triangular-shaped mounting brackets 50. A pair of support stays 53 are cantilevered from the banana bracket 51 and provide a support basis for the backrest cushion 52 (FIG. 2). An adjustable headrest assembly 56 is inserted in between the stays 53 and secured in a relative position by means of a coupling member 54 which includes a ratchet mechanism 55. The headrest assembly includes a tongue portion 58 which is inserted through the coupling member 54, as the tongue member is inserted between the stays 53.

The footrest assembly 26 is pivotally coupled to the seat frame 36 by means of a pair of cam links 60. The footrest assembly 26 comprises a pair of parallel mainframe members 64 attached to one another by a cross member 65.

A pair of bearing wheels 66 are rotatably attached to the reference frame 40 for engaging the cam surface 62 of the cam links 60. Each of the cam links 60 includes a cam surface 62 for engaging the bearing wheels 66. As the seat frame 36 moves relative to the reference frame 40, the cam surface 62 engages the bearing wheel, which will change the orientation of the footrest assembly 26.

The reference frame 40 is vertically supported by means of a height adjustment assembly 32 which comprises essentially a parallelogram linkage. This height adjustment assembly specifically comprises a main vertical support member 68 and a pair of parallelogram support arms 70. The main vertical support member 68 and the parallelogram arms are pivotally coupled, on one end, to upstanding mounting brackets 72 on one end, and to a lower portion of the reference frame 40 on opposite ends. A vertical drive means in the form of a screw jack assembly 74 is used to move the chair vertically. The screw jack assembly 74 comprises a motor or drive means 76 which rotates a threaded extension portion 78. The motor is mounted to the base by means of a motor bracket 80 which is pivotally coupled to a base plate mount 82. A threaded coupling 86 is pivotally mounted, in turn, to a pair of flanges 84 which extend down from the main vertical support member 68. As the screw jack assembly rotates the threaded portion 78, the threaded coupling 86 is drawn toward the motor 76, which causes the parallelogram linkage to lower the dental patient's chair in a vertical position.

The inclining and reclining of the seat chair is actuated by a seat drive means in the form of a second screw jack assembly, which comprises a motor 92 which rotates a screw or threaded extension portion 94. The motor 92 is pivotally secured by means of a motor mounting bracket 96 to a mounting member 98 attached to the cross bar of the backrest assembly 22. The threaded extension portion 94 is threadably inserted into a threaded coupling 100 which is secured, in turn, to a coupling mount attached to the cross bar 37 of the seat frame 36. When it is desired to move the chair into an inclined position, the screw jack assembly 90 rotates the threaded portion 90 which draws the coupling 100 toward the motor 92. This causes the butterfly linkage member 42 and the boomerang-shaped linkage member 44 to rotate (counterclockwise as shown in FIG. 2). This causes the seat frame 36 to move simultaneously in backward and upward directions relative to the reference frame 40 in a manner which replicates the movement of the human body upon articulation. The specific degree and amount of vertical and horizontal movement of the seat frame 36 depends upon the lengths of the butterfly and boomerang linkage members. These have been determined by computer-simulation of the exact articulation of the human body.

Figure 4:
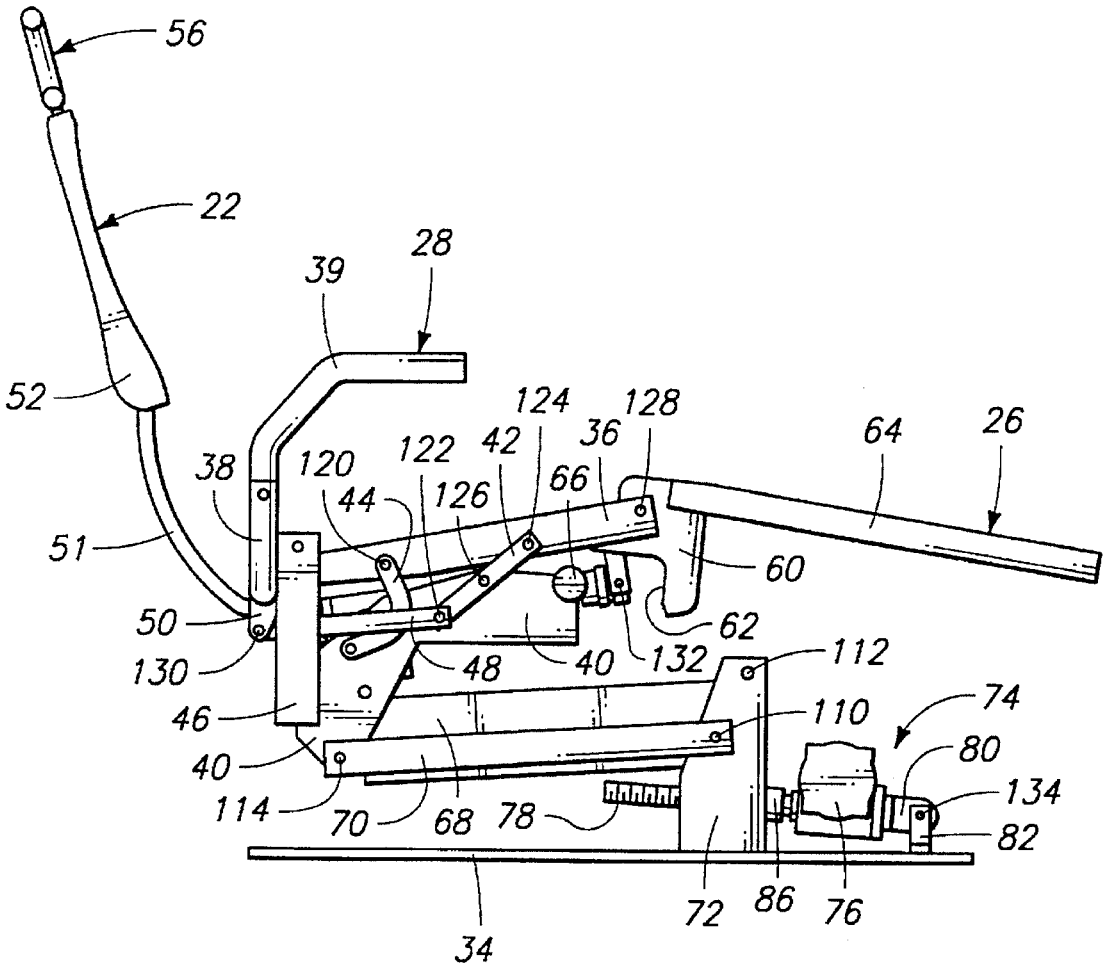
FIG. 4 is a side elevation view of the dental patient's chair of FIG. 1 in a lowered position.
Figure 5:
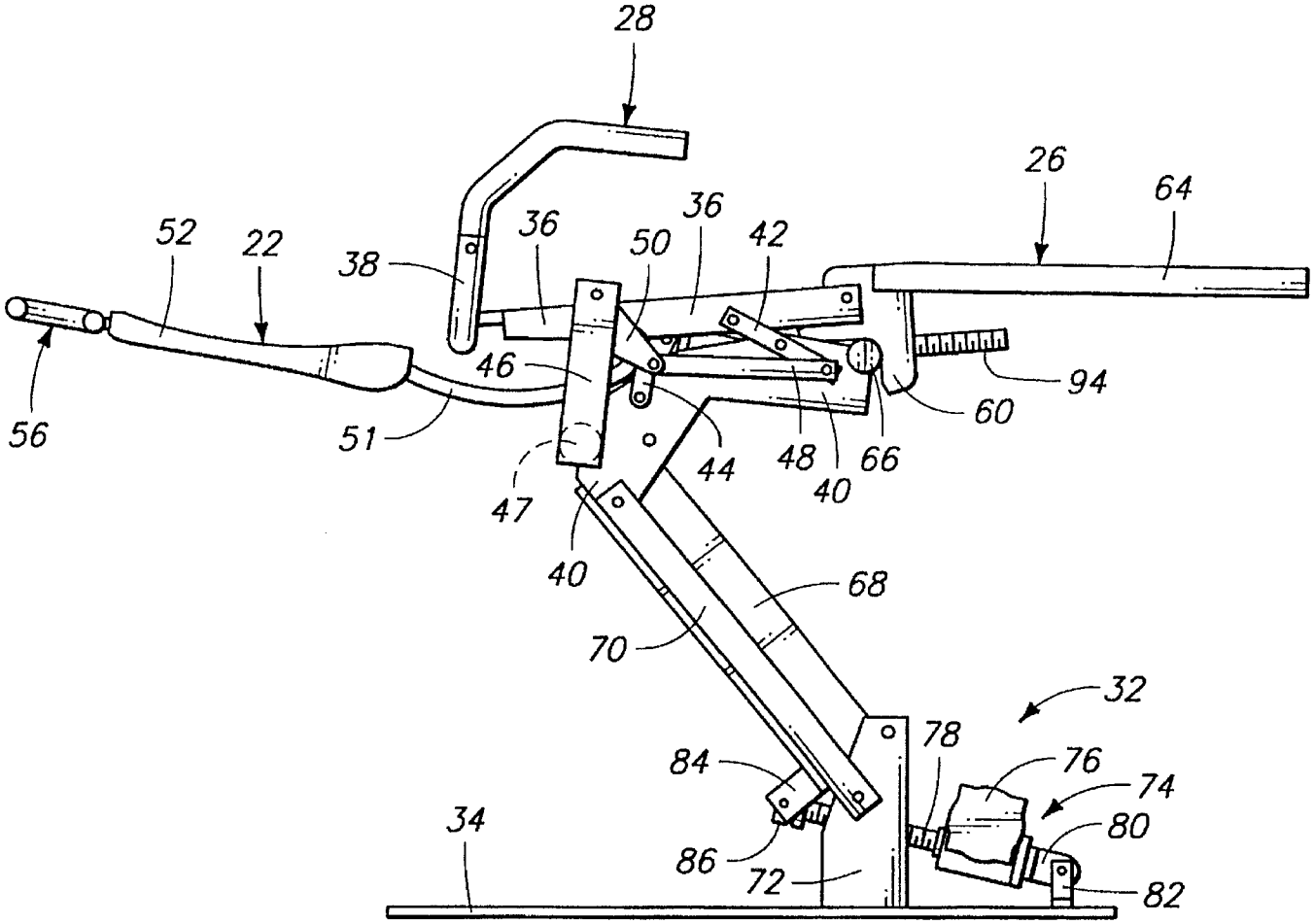
FIG. 5 is a side elevation view of the dental patient's chair of FIG. 1 showing the chair in a fully inclined position.

With reference to FIG. 4, the various pivot points are disclosed. The lower parallelogram linkage, which allows for the vertical movement of the chair, is defined by pivot points 110, 112, 114 and 116. The boomerang-shaped member 44 is pivotally mounted to the reference frame at pivot point 118, and pivotally mounted to the seat frame at pivot point 120. The butterfly linkage member 42 is pivotally coupled to the reference frame 40 at pivot point 126. The butterfly member is further pivotally coupled on one end to the push bar 48 at pivot point 122 and at an opposite end at pivot point 124 on the seat frame. The backrest assembly rotates about pivot point (on triangular shaped piece 50 just above point 130 in FIG. 4) when the backrest is rotated relative to the seat frame assembly.

Figure 7:
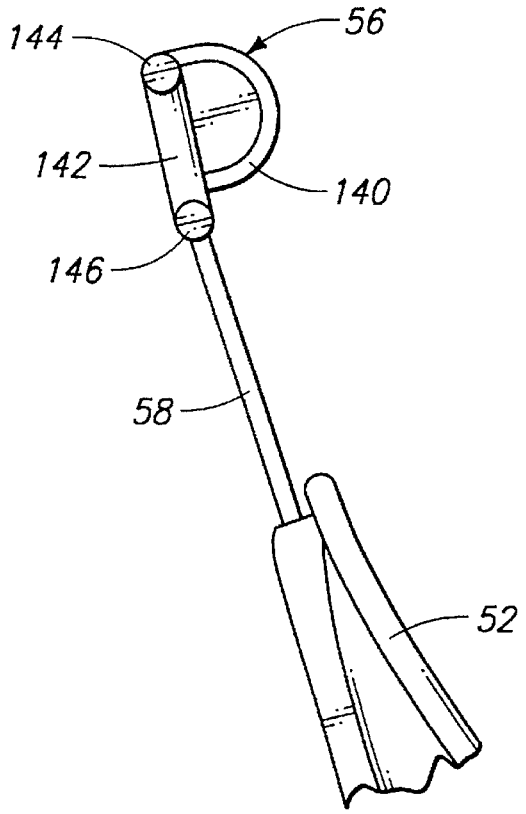
FIG. 7 is a side elevation view of the headrest assembly.

FIG. 7 shows one possible position of the headrest assembly 56. The headrest assembly includes a headrest cushion 140 which is pivotally secured to a dual pivot member 42 at pivot point 144. The dual pivot member 142 is coupled, in turn, to the tongue member 58 of the headrest assembly at pivot point 46. In the position shown in FIG. 7, the headrest assembly is at an extended position for a tall person.

Figure 8:
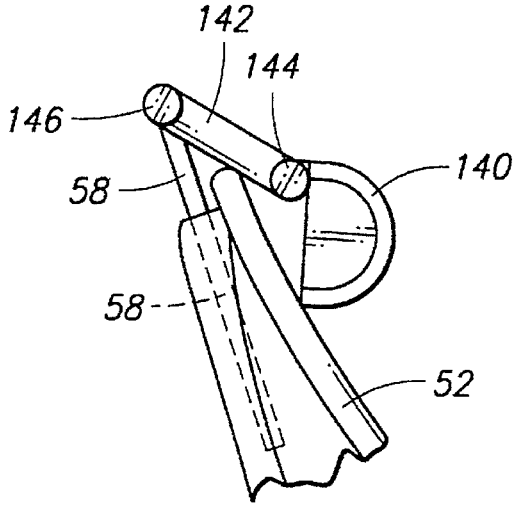
FIG. 8 is a side elevation view of the headrest assembly in an alternate position.

FIG. 8 shows an alternative position of the headrest assembly 56 with the headrest cushion 140 being articulated at pivot point 144 to allow the tongue 58 to be inserted into the seat cushion area 52 and to allow the dual pivot member 142 to be articulated down. In the position shown in FIG. 8, the headrest assembly 56 can be adjusted to suit a small person or child.

Figure 9:
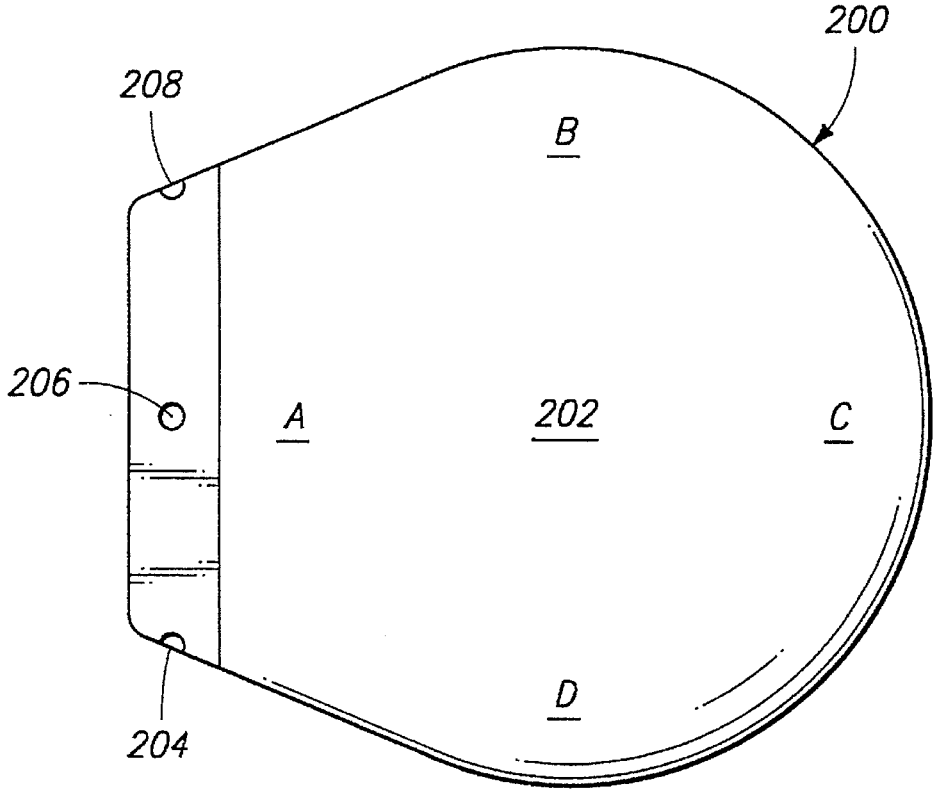
FIG. 9 is a top view of a foot control apparatus according to the present invention.
Figure 10:
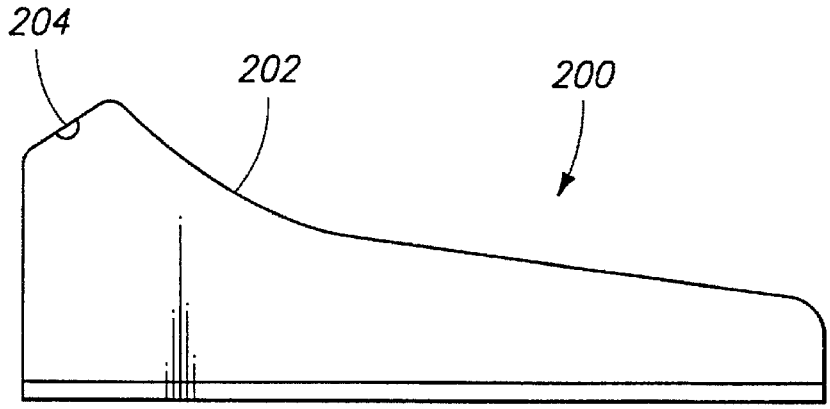
FIG. 10 is a side elevation view of the foot control apparatus of FIG. 9.

FIG. 9 shows a foot control apparatus according to the present invention. The foot control apparatus includes an outer shell 202 and a plurality of apertures 204, 206, 208, which allow infrared beams to be transmitted to receiving devices in the dental patient's chair. The foot control apparatus includes four main areas, A, B, C, and D, on the top surface of the shell 202. By manipulating the foot control apparatus (discussed below), the dental patient's chair is fully and completely adjustable without the need for the treating physician to adjust any hand-operated control mechanisms.

Figure 11:
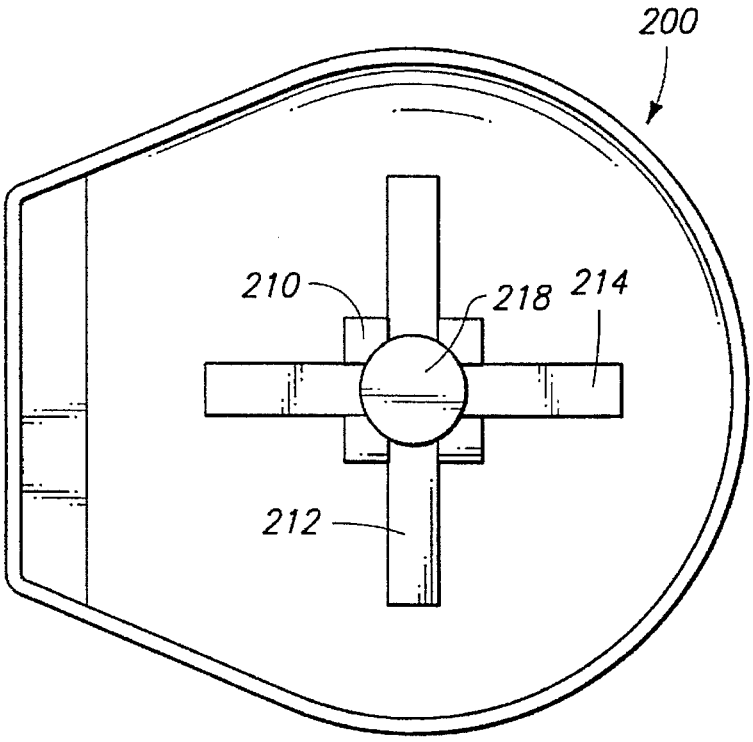
FIG. 11 is a partial bottom view of the foot control apparatus of FIG. 9.
Figure 12:
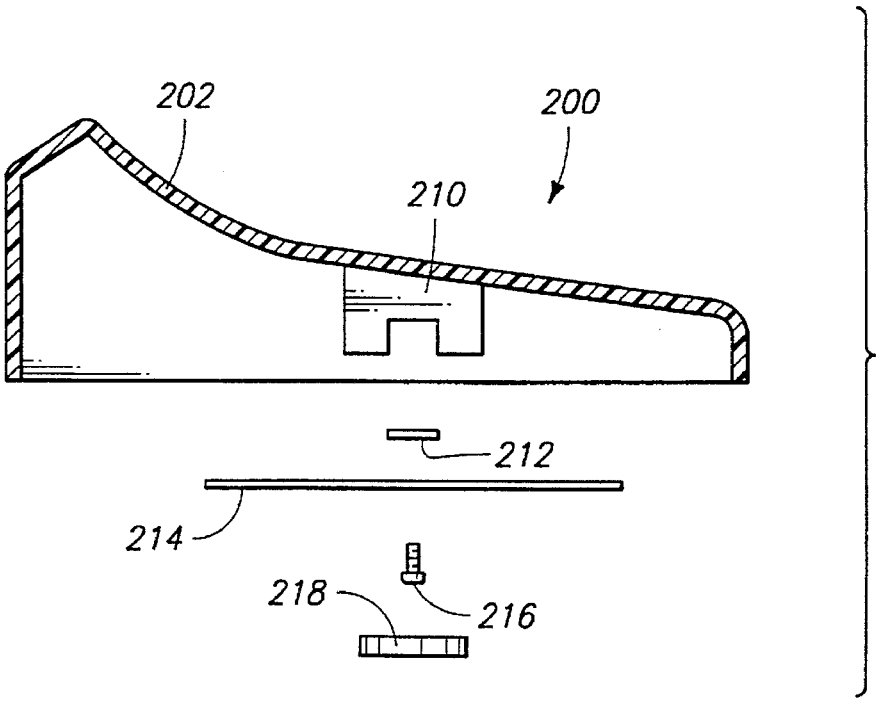
FIG. 12 is a sectional, exploded view of some of the components of the foot control apparatus shown in FIG. 11.

FIG. 11 shows a bottom view of a portion of the foot control assembly. A trapezoid-shaped piece 210 is mounted to the underside of the shell 202. The trapezoid piece provides an lower horizontal surface (since the foot control has a curved outer surface) which enables an even vertical force to be placed upon the other members of the foot control apparatus. A pair of spring steel members 212, 214 are mounted in a crosswise fashion to the underside of the trapezoid-shaped piece 210 by means of a fastener 216. The extreme ends of the spring steel members 212, 214 provide the means for creating the actuating force or forces to operate the foot control apparatus. A resilient spacer 218 is positioned under the trapezoid-shaped piece 210 to allows the cover to tilt in its mounted position.

Figure 13:
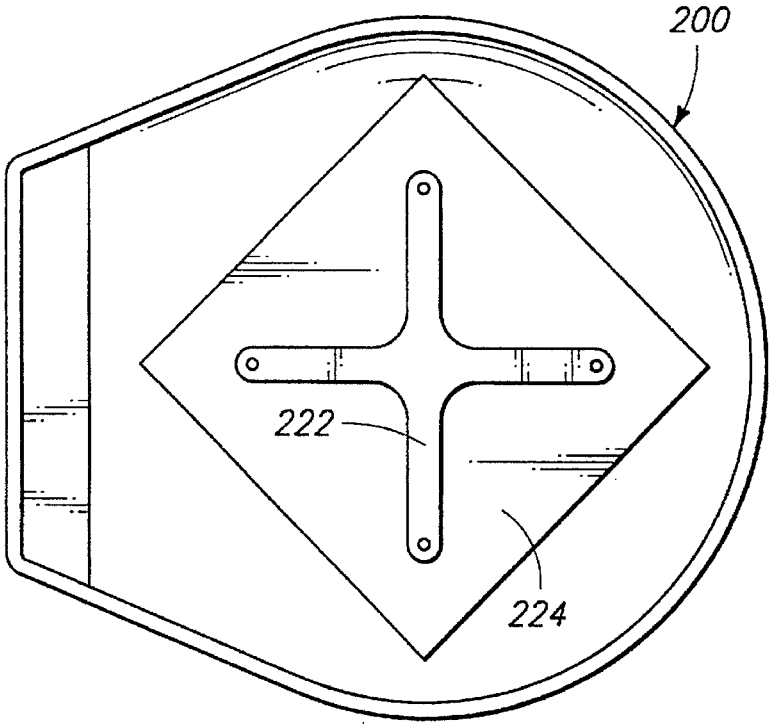
FIG. 13 is a bottom view of the foot control apparatus of FIG. 9 without the base.
Figure 14:
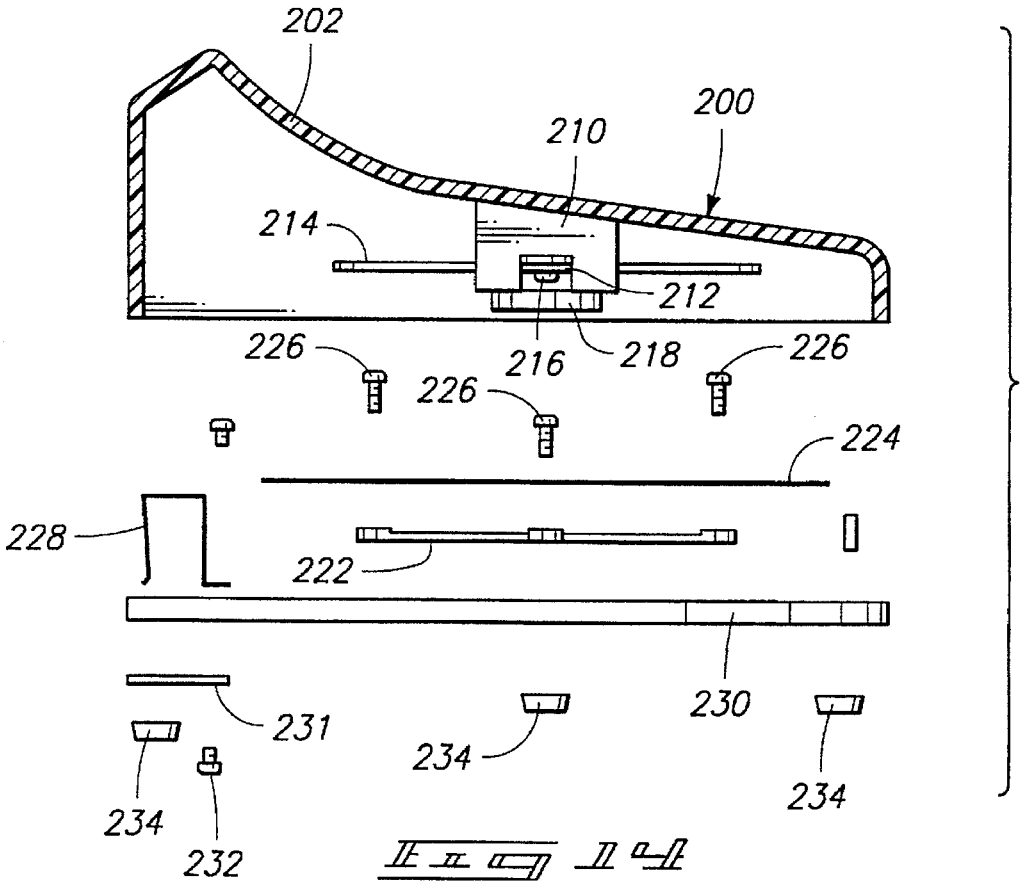
FIG. 14 is an exploded side elevation view of the components of the foot control apparatus of FIG. 13.

As shown in FIGS. 13 and 14, the footrest assembly further comprises a circuit board 224 which is attached to the base 230 of the foot control apparatus through a spacer 222. A plurality of switches (not shown) are coupled to the circuit board. A plurality of fasteners 226 are inserted through the circuit board 224 through the spacer 220 and threadedly received by the base 230. A battery (not shown), which provides power to the circuit board and the infrared emitter (not shown), is held by a retaining clip 228 mounted to the base 230. A removable cover 231 is secured to the exposed, bottom side of the base 230 by means of a fastener 232. The cover 230 can be removed to provide access to the battery storage area. A plurality of rubber feet 234 are further attached to the bottom surface of the base 230.

When pressure is applied to any location of the outer edge of the cover, the cover will tilt and contact one or more switches mounted on the circuit board. That is, the spring arms will actuate one or more of the switches. This will case the microcomputer in the foot control to send a signal, preferably an infra red signal or signals, to the receiver on the patient's chair. These switches may be timer switches so that a tap or series of taps on a location of the edge of the cover will cause a particular signal to be sent from the foot control to the receiver on the patient's chair. The foregoing are but examples of the various signals that may be generated by the foot control and the various ways for actuating switches on the circuit board inside the foot control assembly.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A chair for a patient undergoing treatment, comprising:

a seat frame assembly;

a main frame assembly;

a backrest assembly pivotally coupled to the main frame assembly, the seat frame assembly being located at a spaced distance from the backrest assembly when the backrest assembly is in an upright position;

a linkage assembly interconnecting the seat frame assembly, the main frame assembly, and the backrest assembly, the linkage assembly being positioned exclusively beneath the seat frame assembly, the linkage assembly causing the backrest assembly to move greater than one-half of the spaced distance toward the seat rest assembly upon downward articulation of the backrest assembly, the seat frame assembly moving upwardly and rearwardly to compensate for and to simulate movement of a patient's pelvic bone, upper legs, and lower backbone such that a patient's body remains in a similar position relative to the backrest assembly and seat frame assembly.

2. A chair for a patient undergoing treatment according to claim 1 wherein the linkage assembly further comprises:

a butterfly linkage member pivotally mounted to the main frame assembly and pivotally connected to the seat frame assembly, the butterfly linkage member being coupled to the backrest assembly;

a boomerang linkage member pivotally mounted to the main frame assembly and pivotally connected to the seat frame assembly to cause the seat frame assembly to move simultaneously in the vertical direction and the horizontal direction upon articulation of the backrest assembly.

3. A chair for a patient undergoing treatment according to claim 1 wherein the seat frame assembly is oriented in a particular angle of inclination relative to the horizontal, wherein the linkage assembly further comprises:

a butterfly linkage member pivotally mounted to the main frame assembly and pivotally connected to the seat frame assembly, the butterfly linkage member being coupled to the backrest assembly;

a boomerang linkage member pivotally mounted to the main frame assembly and pivotally connected to the seat frame assembly to cause the angle of inclination of the seat frame assembly to change upon articulation of the backrest relative to the main frame assembly.

4. A chair for a patient undergoing treatment according to claim 1 further comprising a drive means coupled to at least one of the main frame assembly, the backrest assembly, the seat frame assembly, or the linkage assembly for moving the backrest relative to the seat frame.

5. A chair for a patient undergoing treatment according to claim 4, further comprising a sensor means operatively coupled to the drive means for receiving a signal from a remote location and causing the drive means to move the chair in response to the signal.

6. A chair for a patient undergoing treatment according to claim 4, further comprising:

a sensor operatively coupled to the drive means;

a signal emitter located remote and separate from the main frame assembly, the seat rest assembly, and the backrest assembly, the emitter sending a signal to the sensor;

wherein the sensor receives a signal from the signal emitter which causes the drive means to move the chair in response to the signal.

7. A chair for a patient undergoing treatment according to claim 6 wherein the emitter sends a plurality of different signals and the sensor receives a plurality of different signals from the emitter to cause the drive means to move the chair in different positions in response to the different signals.

8. A chair for a patient undergoing treatment according to claim 1, further comprising a drive coupled between the backrest assembly and the seat frame assembly to move the backrest assembly relative to the seat frame assembly.

9. A chair for a patient undergoing treatment, comprising:

a seat frame assembly;

a main frame assembly;

a backrest assembly pivotally coupled to the seat frame assembly, the seat frame assembly being located at a spaced distance from the backrest assembly when the backrest assembly is in an upright position;

linkage means for interconnecting the seat frame assembly, the main frame assembly, and the backrest assembly, the linkage means being positioned exclusively beneath the seat frame assembly, the linkage means causing the backrest assembly to move greater than one-half of the spaced distance toward the seat rest assembly upon downward articulation of the backrest assembly, the seat frame assembly moving upwardly and rearwardly to compensate for and to simulate movement of a patient's pelvic bone, upper legs, and lower backbone such that a patient's body remains in a similar position relative to the backrest assembly and the seat frame assembly.

10. A chair for a patient undergoing treatment according to claim 9 wherein the linkage means for moving the seat frame assembly moves the seat frame assembly simultaneously in the vertical direction and the horizontal direction upon articulation of the backrest assembly.

11. A chair for a patient undergoing treatment according to claim 9 wherein the seat frame assembly is oriented at a particular angle of inclination relative to the horizontal, wherein the linkage means for moving the seat frame assembly causes the angle of inclination of the seat frame assembly to change upon articulation of the backrest assembly relative to the main frame assembly.

12. A chair for a patient undergoing treatment according to claim 9, further comprising a drive means coupled to at least one of the main frame assembly, the backrest assembly, the seat frame assembly, or the linkage assembly for moving the backrest relative to the seat frame.

13. A chair for a patient undergoing treatment according to claim 9, further comprising a drive means coupled between the backrest frame and the seat frame.

14. A chair for a patient undergoing treatment according to claim 13, further comprising a sensor means operatively coupled to the drive means for receiving a signal from a remote location and causing the drive means to move the chair in response to the signal.

15. A chair for a patient undergoing treatment according to claim 13, further comprising:

a sensor operatively coupled to the drive means;

a signal emitter located remote and separate from the main frame assembly, the seat rest assembly, and the backrest assembly, the emitter sending a signal to the sensor;

wherein the sensor receives a signal from the signal emitter which causes the drive means to move the chair in response to the signal.

16. A chair for a patient undergoing treatment according to claim 15 wherein the emitter sends a plurality of different signals and the sensor receives a plurality of different signals from the emitter to cause the drive means to move the chair in different positions in response to the different signals.

17. A chair for a patient undergoing treatment according to claim 9 wherein the seat frame assembly moves simultaneously in the vertical and horizontal directions upon articulation of the backrest assembly.

18. A chair for a patient undergoing treatment, comprising:

a seat frame assembly;

a main frame assembly;

a backrest assembly pivotally connected to the seat frame assembly, the seat frame assembly being located at a spaced distance from the backrest assembly when the backrest assembly is in an upright position;

a linkage assembly interconnecting the seat frame assembly and the main frame assembly, the linkage assembly comprising a butterfly link and a boomerang link, the butterfly link have a top portion, a middle portion, and a bottom portion, the butterfly link being pivotally coupled to the main frame assembly at the middle portion, the butterfly link being pivotally coupled at the top portion of the seat frame assembly, the butterfly link being pivotally coupled at the bottom portion to the backrest assembly, the boomerang link having a top end and a bottom end, the top end being pivotally attached to the seat frame assembly and the bottom end being pivotally attached to the main frame assembly, the linkage assembly causing the backrest assembly to move greater than one-half of the spaced distance toward the seat rest assembly upon downward articulation of the backrest assembly relative to the main frame assembly.

19. A chair for a patient undergoing treatment according to claim 18 wherein the seat frame assembly is oriented at a particular angle of inclination relative to the horizontal, wherein the linkage assembly causes the angle of inclination of the seat frame assembly to change upon articulation of the backrest relative to the seat frame assembly.

20. A chair for a patient undergoing treatment according to claim 18 further comprising a drive means coupled to the main frame for moving the backrest relative to the seat frame.

21. A chair for a patient undergoing treatment according to claim 20, further comprising a sensor means operatively coupled to the drive means for receiving a signal from a remote location and causing the drive means to move the chair in response to the signal.

22. A chair for a patient undergoing treatment according to claim 20, further comprising:

a sensor operatively coupled to the drive means;

a signal emitter located remote and separate from the main frame assembly, the seat rest assembly, and the backrest assembly, the emitter sending a signal to the sensor;

wherein the sensor receives a signal from the signal emitter which causes the drive means to move the chair in response to the signal.

23. A chair for a patient undergoing treatment according to claim 22 wherein the emitter sends a plurality of different signals and the sensor receives a plurality of different signals from the emitter to cause the drive means to move the chair in different positions in response to the different signals.

* * * * *